US008377224B2

(12) United States Patent
Grunert

(10) Patent No.: US 8,377,224 B2
(45) Date of Patent: Feb. 19, 2013

(54) CLEANING DEVICE FOR A COMPONENT LOADED WITH LINT IN A HOUSEHOLD APPLIANCE, AND METHOD FOR CLEANING A COMPONENT LOADED WITH LINT

(75) Inventor: Klaus Grunert, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 316 days.

(21) Appl. No.: 12/746,544

(22) PCT Filed: Nov. 21, 2008

(86) PCT No.: PCT/EP2008/065973

§ 371 (c)(1),
(2), (4) Date: Jun. 7, 2010

(87) PCT Pub. No.: WO2009/077291

PCT Pub. Date: Jun. 25, 2009

(65) Prior Publication Data

US 2010/0263692 A1 Oct. 21, 2010

(30) Foreign Application Priority Data

Dec. 18, 2007 (DE) ..... 10 2007 060 854

(51) Int. Cl.
*B08B 3/00* (2006.01)
*F26B 19/00* (2006.01)

(52) U.S. Cl. ..... 134/34; 134/42; 34/85; 68/3 R

(58) Field of Classification Search ..... None
See application file for complete search history.

(56) References Cited

U.S. PATENT DOCUMENTS

| | | | | |
|---|---|---|---|---|
| 3,293,890 | A | 12/1966 | Valdespino et al. | |
| 5,186,192 | A * | 2/1993 | Netsu et al. | 134/68 |
| 2006/0179676 | A1 * | 8/2006 | Goldberg et al. | 34/77 |
| 2009/0031513 | A1 | 2/2009 | Goldberg et al. | |

FOREIGN PATENT DOCUMENTS

| | | | |
|---|---|---|---|
| DE | 3738031 | A1 * | 5/1989 |
| DE | 4132431 | A1 | 4/1993 |
| DE | 4333901 | C1 | 2/1995 |
| DE | 19943125 | A1 | 11/2000 |

OTHER PUBLICATIONS

English Machine Translation of DE 3738031 A1, pp. 1-3.*

* cited by examiner

*Primary Examiner* — Michael Kornakov
*Assistant Examiner* — Nicole Blan
(74) *Attorney, Agent, or Firm* — James E. Howard; Andre Pallapies

(57) ABSTRACT

A cleaning device for a component loaded with lint in a household appliance for laundry care. The cleaning device includes a rinsing unit to guide rinsing fluid to the component to remove the lint. The rinsing unit has a flow element disposed above the component, and the flow element builds up a dynamic pressure of the rinsing fluid in the flow element.

17 Claims, 1 Drawing Sheet

CLEANING DEVICE FOR A COMPONENT LOADED WITH LINT IN A HOUSEHOLD APPLIANCE, AND METHOD FOR CLEANING A COMPONENT LOADED WITH LINT

BACKGROUND OF THE INVENTION

The invention relates to a cleaning device for a component loaded with lint in a household appliance for laundry care, having a rinsing unit by means of which rinsing fluid can be conducted to the component to remove the lint. The invention also relates to a household appliance with such a cleaning device and a method for cleaning a component loaded with lint in a household appliance for laundry care, in which rinsing fluid can be conducted to the component with a rinsing unit.

A cleaning device for a component within a process air circuit of a household tumble dryer is known from WO 2007/093468 A1. The component is a heat exchanger, which is assigned to a heat pump of a dryer. During operation of the dryer lint conveyed in the process air circuit, which is detached from the laundry items to be dried, can be filtered through a filter. Lint still passes through the filter and can reach a heat exchanger, where it is deposited. A brush may be provided to remove such lint from the heat exchanger. Provision may also be made for the heat exchanger to be rinsed with a cleaning fluid. The cleaning fluid used may be the condensate of the working medium evaporator or the condensation unit of the dryer.

However it can happen with such units that the component is only rinsed relatively irregularly and therefore the lint continues to remain deposited on at least parts of the component.

BRIEF SUMMARY OF THE INVENTION

The object of the present invention is to create a cleaning device and a household appliance with such a cleaning device and a method for cleaning a component loaded with lint, in which lint removal can be effected in an improved manner and in particular the rinsing fluid provided for removal purposes can be distributed more regularly on the component.

This object is achieved by a cleaning device, a household appliance and a corresponding method. Preferred embodiments of the invention will emerge from corresponding dependent claims, it being possible also to combine the subject matter of such claims within the context of the invention, as far as is technically possible. A preferred development of the inventive household appliance and the inventive method corresponds to each preferred development of the inventive cleaning device and vice versa, even if this is not explicitly stated in each instance.

An inventive cleaning device for a component loaded with lint in a household appliance for laundry care comprises a rinsing unit, by means of which rinsing fluid can be conducted to the component to remove the lint. The rinsing unit comprises a flow element, which is disposed above the component and is configured to build up a dynamic pressure of the rinsing fluid in the flow element. This embodiment of the rinsing unit allows a regular application to the places on the component to be cleaned, so the lint is removed from many places on the component with identical effect or identical efficiency.

The flow element preferably has an elongated part, which has an opening for the egress of fluid on the side facing the component. This specific form of a part of the flow element allows the specific supply of fluid in particular over the entire width of the component so that here too a regular application of fluid can be ensured in conjunction with the generation of dynamic pressure of the rinsing fluid in the flow element.

To build up a dynamic pressure the flow element preferably has a cross section that has at least one narrow point. Such a constriction or tapering of the interior dimension of the flow element ensures that a dynamic pressure is generated and that there is therefore the most regular outflow of fluid possible from the flow element over the entire extent of the opening. Such a specific embodiment of the flow element can also ensure that a dynamic pressure is generated in a relatively simple manner.

The flow element is preferably embodied so that before and after the narrow point it has an interior dimension that is larger than the interior dimension at the narrow point. The elongated part of the flow element is therefore preferably designed with a form in the manner of an hour glass.

In addition to a particularly preferred generation of the dynamic pressure this form also allows a sufficient quantity of fluid to flow out of the opening of the flow element and also allows a flow speed to be achieved that is adequate to rinse out the lint.

The narrow point preferably extends over the length, in particular over the entire length, of the elongated part of the flow element.

Provision can be made for the narrow point to be configured symmetrically in cross section. Provision can however also be made for the narrow point to be designed asymmetrically in cross section.

The opening in the elongated part of the flow element, which is configured on the side facing the component, preferably extends over the length, in particular over the entire length, of this part. The opening is therefore preferably in the manner of a slot or slit.

Provision can be made for the narrow point to be configured with the same dimensions over the length of the flow element. Provision can however also be made for these dimensions of the narrow point to vary at least once and have different dimensioning in the longitudinal direction of the flow element.

The flow element preferably comprises at least one element for positioning and/or holding the flow element on the component loaded with lint. This ensures the reliable attachment and continued positioning of the flow element.

In particular the element for positioning and/or holding the flow element on the component is disposed on the elongated part of the flow element, in particular being configured as a single piece on this.

An element for positioning and/or holding the flow element is preferably disposed on a side of the elongated part of the flow element facing the component and extends from this downward. This allows particularly simple attachment by slipping or pushing onto the component. This embodiment also means that the flow element is not able to be displaced laterally or to slip laterally in relation to the component.

Such an embodiment also allows particularly simple reversibly releasable attachment of the flow element to the component so that it can be slipped or pushed on simply and can be removed simply during disassembly.

The flow element preferably comprises at least two elements for positioning and/or holding it, which are disposed on the opposing ends of the elongated part of the flow element and extend downward parallel to one another. Such an embodiment allows the fixing and mechanically stable attachment to be improved still further.

The flow element preferably has a connector for a supply line for the rinsing fluid, which is disposed in particular on a side of the elongated part of the flow element facing away from the component. For such an embodiment it is possible to allow simple connection of the flow element to a supply line, which also allows the rinsing fluid to be supplied in a particularly favorable manner and additionally does not impede the building up of the dynamic pressure on the one hand and the inflow of the rinsing fluid into the component on the other hand.

The flow element is in particular configured as a single piece. It proves to be favorable in this context if the flow element is configured as a single-piece injection molded part. This allows a component that can be produced quickly and economically to be created, which can also be configured with a very low weight.

A further aspect of the invention relates to a household appliance with an inventive cleaning device or an advantageous embodiment thereof. The household appliance for laundry care is configured in particular as a tumble dryer. The tumble dryer preferably comprises a heat pump, which has a heat exchanger, which serves to evaporate a working medium in the heat pump circuit, and comprises a further heat exchanger, which serves to condense a working medium in the heat pump circuit.

The component loaded with lint is in particular a heat exchanger.

In an inventive method for cleaning a component of a household appliance for laundry care loaded with lint rinsing fluid is conducted to the component with a rinsing unit. The lint is removed from the component by the rinsing fluid. In a flow element assigned to the rinsing unit the interior form of said flow element causes a dynamic pressure of the rinsing fluid to build up in the flow element. This allows a regular application of rinsing fluid to the component to be achieved in different regions, thereby also allowing more efficient and more regular removal of the lint.

Advantageous embodiments of the inventive cleaning device should be considered to be advantageous embodiments of the inventive method.

BRIEF DESCRIPTION OF THE DRAWINGS

Exemplary embodiments of the invention are described in more detail below with reference to schematic drawings, in which.

DETAILED DESCRIPTION OF EXEMPLARY EMBODIMENTS OF THE PRESENT INVENTION

Figure 1:
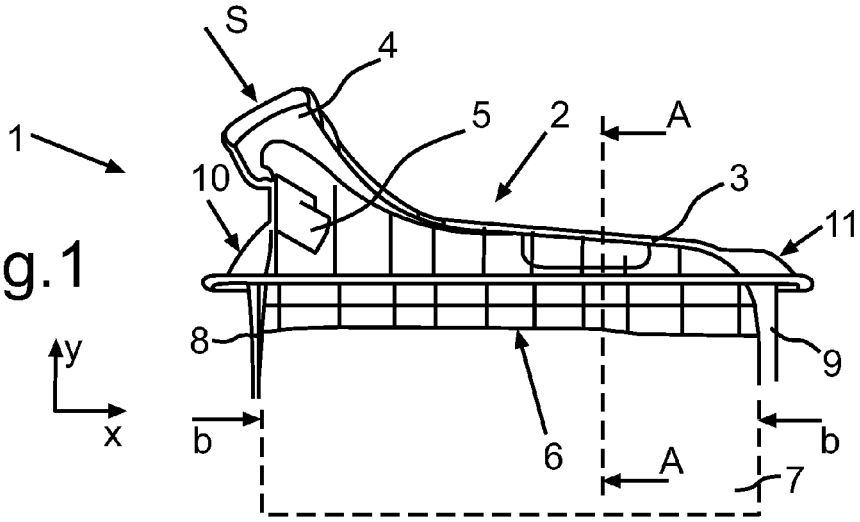
FIG. 1 shows a schematic sectional diagram of a flow element of an inventive cleaning device.

Identical elements or elements of identical function are shown with the same reference characters in all the figures.

FIG. 1 shows a diagram of a longitudinal section of an exemplary embodiment of a flow element 2, which is assigned to a cleaning device 1. The cleaning device 1 is disposed in a tumble dryer and comprises a rinsing unit, to which the flow element 2 is assigned. In this cleaning device 1 lint is removed in a component of the tumble dryer configured as a heat exchanger 7, in that rinsing fluid is conducted through the rinsing unit and the flow element 2 and then also through the heat exchanger 7.

The rinsing fluid is in particular a condensate collected in the tumble dryer, which occurs during operation of the tumble dryer. The heat exchanger 7 can preferably be assigned to a heat pump of the tumble dryer.

The flow element 2 is disposed above the heat exchanger 7, which is only illustrated symbolically and with a broken line in FIG. 1. Provision is made in particular for the flow element 2 to be placed or slipped directly onto the heat exchanger 7.

The flow element 2 of the rinsing unit is configured as a single piece and comprises an elongated part 3 and a connector 4 connected to the elongated part 3. In the embodiment according to FIG. 1 the connector 4 extends obliquely upward on the side of the flow element 2 facing away from the heat exchanger 7. A supply line for the rinsing fluid S can be connected to the connector 4.

Flow aids 5 are disposed in the interior of the flow element 2, to conduct the rinsing fluid S from the connector 4 into the elongated part 3 in a manner that is optimized in respect of flow.

On its lower side facing away from the connector 4 and facing toward the heat exchanger 7 the elongated part 3 has an opening 6, through which the rinsing fluid exits from the flow element 2 in the direction of the heat exchanger 7. The opening 6 extends essentially over the entire length or width b (extension in x-direction), the length of the elongated part 3 being measured in the x-direction for this purpose. The opening 6 is therefore configured in the manner of a slot or slit.

Elements 8 and 9 for positioning and/or holding the flow element 2 on the heat exchanger 7 are configured on the elongated part 3. The elements 8 and 9 are formed on opposing ends 10 and 11 of the elongated part 3 and extend essentially parallel to one another downward in the direction of the heat exchanger 7. In a vertical direction (y-direction) the elements 8 and 9 are configured longer in a downward direction than the elongated part 3, so that they engage with the outside of the heat exchanger 7 and the flow element 2 can therefore be pushed or slipped onto the heat exchanger 7 and this position can be held by the elements 8 and 9.

The flow element 2 and in particular the elongated part 3 are configured and formed internally so that they are configured to build up a dynamic pressure of the rinsing fluid S in the flow element 2.

Figure 2:
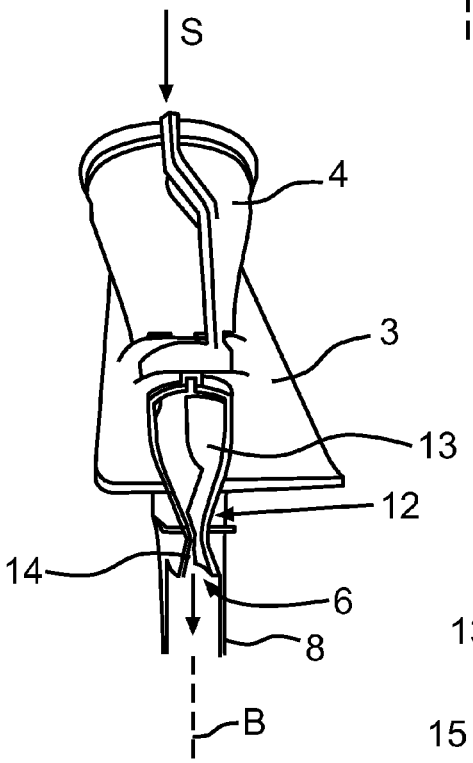
FIG. 2 shows a further sectional diagram of a first exemplary embodiment of a flow element of an inventive cleaning device according to FIG. 1.

To this end, according to the cross-sectional diagram along the section line AA in FIG. 1, the elongated part 3 has a narrow point 12, as shown in FIG. 2. In the cross-sectional diagram according to FIG. 2 the elongated part 3 has an embodiment that is symmetrical in respect of the vertical axis B, so that the narrow point 12 is formed by an arching of the inner wall of the elongated part 3 on both sides. The elongated part 3 is configured with a larger interior dimension in cross section above and below the narrow point 12, so that the cross-sectional form of the elongated part 3 is designed in the manner of an hour glass.

The narrow point 12 forms an upper chamber 13 above it in the vertical direction in the elongated part 3 and a lower chamber 14 below the narrow point 12. Such dimensioning allows the dynamic pressure in the flow element 2 to be formed in a preferred manner so that the most regular egress of rinsing fluid S possible can be achieved by way of the opening 6 with the most regular flow speed of the rinsing fluid S possible over the entire length b. This allows a regular application of the rinsing liquid S to the fins of the heat exchanger 7 to be achieved, it also being possible to achieve regular and efficient removal of the lint over its entire width (x-direction) in this respect.

The flow aids 5 shown by way of example in FIG. 1 allow the fluid distribution in the direction of the width of the heat exchanger 7 to be improved.

The water distribution over the entire length or width b is therefore more regular due to the narrow point 12 in the elongated part 3.

Provision can be made for the constriction or narrow point 12 of the flow cross section to have the same dimensions and forms over the entire length or width b. However provision can also be made for these dimensions and/or forms of the narrow point 12 to vary when considered over the length or width b. The form and dimension of the narrow point 12 can also be enlarged or reduced depending on water distribution requirements over the width b.

Figure 3:
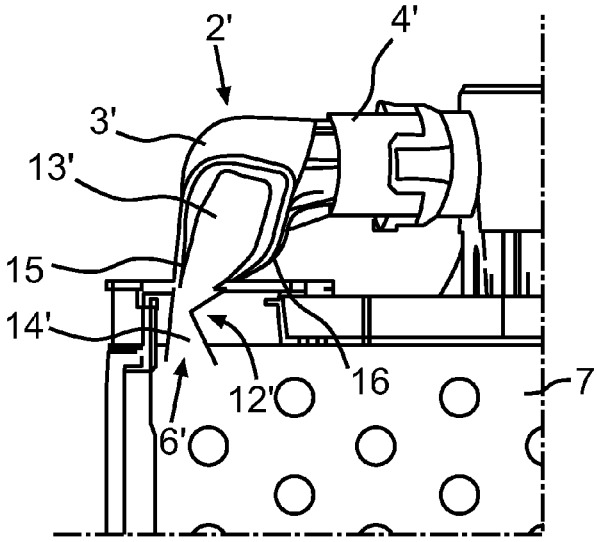
FIG. 3 shows a sectional diagram of the flow element of an inventive cleaning device according to a further exemplary embodiment.

FIG. 3 shows a further exemplary embodiment of a flow element 2' of the cleaning device 1, this diagram showing a cross section similar to the diagram in FIG. 2. In this embodiment the elongated part 3' has an asymmetrical embodiment in relation to the axis B in cross section at the narrow point 12'. This is achieved in that an outer wall 15 of the elongated part 3' has a form that does not arch inward or only does so to a small degree. On the other hand the opposing inner wall 16 of the elongated part 3' has at least one depression in the direction of the outer wall 15, which is present or is greater than a possible depression in the outer wall 15 in the direction of the inner wall 16. Here too the narrow point 12' is disposed so that an upper chamber 13' is formed above and a lower chamber 14' below. In cross section the elongated part 3' has a larger interior dimension both above and below the narrow point 12' than at this narrow point 12'.

The rinsing fluid S is introduced back into the heat exchanger 7 by way of the opening 6'. The flow element 2' is connected to a supply line for the rinsing fluid S by way of the connector 4'.

It can also be seen from FIG. 3 that the flow element 2' is disposed above the heat exchanger 7 and in particular is secured directly to this in a releasable manner.

In the exemplary embodiments shown the opening 6 or 6' has an extent (extension in z-direction, which extends perpendicular to the plane of the figure in FIG. 1), which is larger than the interior dimension in this spatial direction of the narrow point 12 or 12'. Provision can also be made for the interior dimension of the opening 6 or 6' to be equal to the interior dimension of the narrow point 12 or 12' when looked at in this spatial direction, which extends perpendicular to the x-direction in FIG. 1.

A precise position of the flow element 2 or 2' in relation to the depth of the heat exchanger 7 can be achieved by means of laterally attached elements 8 and 9, which preferably engage over the coolant tube of the heat exchanger 7. The flow element 2 or 2' here is disposed in the front region of the heat exchanger 7, because the lint is preferably deposited here. In the rear region of the heat exchanger 7 the lint is removed by the condensate that occurs during the drying process. The flow element 2 or 2' allows the rinsing fluid to flow to the heat exchanger 7 in a regular manner over the width of the component.

The invention claimed is:

1. A cleaning device for a component loaded with lint in a household appliance for laundry care, the cleaning device comprising:

a rinsing unit to guide rinsing fluid to the component to remove the lint, the rinsing unit having a flow element disposed above the component, the flow element to build up a dynamic pressure of the rinsing fluid in the flow element, wherein the flow element has an elongated part having a length, the elongated part having an opening for an egress of fluid on a side facing the component, the flow element has a cross section that includes at least one narrow point to build up the dynamic pressure, and the at least one narrow point extends over substantially the entire length of the elongated part of the flow element.

2. The cleaning device of claim 1, wherein, at least before the at least one narrow point, the flow element has a first interior dimension that is larger than a second interior dimension at the narrow point.

3. The cleaning device of claim 1, wherein the at least one narrow point has a symmetric cross section.

4. The cleaning device of claim 1, wherein the at least one narrow point has an asymmetric cross section.

5. The cleaning device of claim 1, wherein the opening in the elongated part of the flow element on the side facing the component extends over substantially the entire length of the elongated part.

6. The cleaning device of claim 1, wherein the flow element has at least one element to at least one of position and hold the flow element on the component.

7. The cleaning device of claim 6, wherein the at least one element is disposed on the elongated part of the flow element.

8. The cleaning device of claim 7, wherein the at least one element and the elongated part of the flow element are a single piece.

9. The cleaning device of claim 6, wherein the at least one element is disposed on a side of the elongated part of the flow element that faces the component and extends downward.

10. The cleaning device of claim 6, wherein two elements are disposed on respective opposing ends of the elongated part of the flow element and extend downward and parallel to one another.

11. The cleaning device of claim 1, wherein the flow element has a connector for a supply line for the rinsing fluid.

12. The cleaning device of claim 11, wherein the connector is disposed on a side of the elongated part of the flow element that faces away from the component.

13. The cleaning device of claim 1, wherein the component is a heat exchanger.

14. A cleaning device for a component loaded with lint in a household appliance for laundry care, the cleaning device comprising:

a rinsing unit to guide rinsing fluid to the component to remove the lint, the rinsing unit having a flow element disposed above the component, the flow element to build up a dynamic pressure of the rinsing fluid in the flow element, wherein the flow element is configured as a single piece.

15. The cleaning device of claim 14, wherein the single piece is a single-piece injection molded part.

16. A household appliance for laundry care, comprising:

a component loaded with lint; and a rinsing unit to guide rinsing fluid to the component to remove the lint, the rinsing unit having a flow element disposed above the component, the flow element to build up a dynamic pressure of the rinsing fluid in the flow element, wherein the flow element has an elongated part having a length, the elongated part having an opening for an egress of fluid on a side facing the component, the flow element has a cross section that includes at least one narrow point to build up the dynamic pressure, and the at least one narrow point extends over substantially the entire length of the elongated part of the flow element.

17. A method for cleaning a component loaded with lint in a household appliance for laundry care, the method comprising:

guiding rinsing fluid with a rinsing unit to the component for lint removal;

building up a dynamic pressure of the rinsing fluid in a flow element, the flow element having a cross section that includes at least one narrow point to build up the dynamic pressure, wherein the flow element is assigned to the rinsing unit, the flow element has an elongated part having a length, the elongated part having an opening for an egress of fluid on a side facing the component, and the at least one narrow point extends over substantially the entire length of the elongated part of the flow element.

* * * * *